US006612459B2

(12) United States Patent
Young

(10) Patent No.: US 6,612,459 B2
(45) Date of Patent: Sep. 2, 2003

(54) NESTABLE MULTIPLE COMPARTMENT TRAY FOR FAUX PAINTING MATERIAL AND APPLICATORS

(76) Inventor: Todd Young, 3839 E. Country Pl., Springfield, MO (US) 65809

( * ) Notice: Subject to any disclaimer, the term of this patent is extended or adjusted under 35 U.S.C. 154(b) by 0 days.

(21) Appl. No.: 09/946,114

(22) Filed: Sep. 4, 2001

(65) Prior Publication Data

US 2003/0042262 A1 Mar. 6, 2003

(51) Int. Cl.[7] ..... B65D 1/24

(52) U.S. Cl. ..... 220/570; 206/518; 220/553; 220/555

(58) Field of Search ..... 220/501, 552, 220/553, 555, 570, DIG. 12, DIG. 15, 556; 206/515, 518, 561, 557, 564; D7/546, 549, 553.1, 555

(56) References Cited

U.S. PATENT DOCUMENTS

| | | | | | |
|---|---|---|---|---|---|
| D20,487 | S | * | 1/1891 | McBride | D7/555 |
| D147,673 | S | * | 10/1947 | Lester et al. | D7/549 |
| 2,633,656 | A | | 4/1953 | Gemma | |
| 2,661,858 | A | | 12/1953 | Howell | |
| 2,774,511 | A | * | 12/1956 | Menekin | 206/507 |
| D200,249 | S | * | 2/1965 | Hancock | D7/553.2 |
| 3,386,608 | A | * | 6/1968 | Diller | 220/23.6 |
| 3,565,245 | A | * | 2/1971 | Asher et al. | 206/229 |
| 3,776,371 | A | | 12/1973 | Linger | |
| 4,046,250 | A | | 9/1977 | Amezcua | |
| 4,172,542 | A | | 10/1979 | Lankford | |
| 4,398,690 | A | | 8/1983 | Rutledge | |
| 4,572,374 | A | * | 2/1986 | Sirotkin | 206/505 |
| D286,096 | S | | 10/1986 | Jaros et al. | |
| 4,676,468 | A | | 6/1987 | Preston et al. | |
| 4,732,274 | A | | 3/1988 | Bouton | |
| 4,815,604 | A | | 3/1989 | O'Neil et al. | |
| 4,930,632 | A | * | 6/1990 | Eckert et al. | 108/53.3 |
| 4,993,726 | A | | 2/1991 | Schumacher et al. | |
| 5,004,255 | A | | 4/1991 | Briggs | |
| 5,022,183 | A | * | 6/1991 | Bohlmann | 206/423 |
| 5,082,301 | A | | 1/1992 | Schumacher et al. | |
| 5,152,398 | A | * | 10/1992 | Forestal et al. | 206/561 |
| 5,161,710 | A | * | 11/1992 | Chumley | 206/203 |
| D331,992 | S | | 12/1992 | Sheridan | |
| 5,190,303 | A | | 3/1993 | Schumacher et al. | |
| 5,325,990 | A | | 7/1994 | Temple | |
| D352,202 | S | * | 11/1994 | Campbell et al. | D7/546 |
| 5,372,273 | A | * | 12/1994 | Eves | 206/45.24 |
| 5,634,568 | A | | 6/1997 | Wawrzyniak | |
| D447,371 | S | * | 9/2001 | Quinn | D6/510 |

* cited by examiner

*Primary Examiner*—Stephen P. Garbe
*Assistant Examiner*—Joseph C. Merek
(74) *Attorney, Agent, or Firm*—Morgan, Lewis & Bockius LLP

(57) ABSTRACT

A nestable multiple compartment tray (10) for faux painting material and applicators is provided. The tray (10) comprises a rigid one-piece monolithic housing which comprises a bottom wall structure (11) presenting an outer perimeter defined by a plurality of spaced bottom wall segments (12) and a sidewall (14). The tray (10) is further comprised of a series of first divider walls (22 and 24) and at least one second divider wall (26). The sidewall (14) has a plurality of sidewall segments (15) which present front (16), rear (18), and opposing side (20) sections. The divider walls (22, 24, 26) cooperate with the sidewall segments (15) and bottom wall segments (12) to present individual fore (28) and aft (30) compartments. The fore compartments (28) are suited for receiving faux painting applicators and the aft compartments (30) are suited for receiving paint. Each divider wall (22, 24, 26) is constructed with at least partially spaced wall portions (32) which present corresponding cavities (34) therebetween. These wall portions (32) and cavities (34) are configured and oriented to permit interleaving of the divider walls (22, 24, 26) of a plurality of trays in nested stacked relationship.

22 Claims, 3 Drawing Sheets

NESTABLE MULTIPLE COMPARTMENT TRAY FOR FAUX PAINTING MATERIAL AND APPLICATORS

BACKGROUND OF THE INVENTION

1. Field of the Invention

The present invention is broadly concerned with a multiple compartment tray used for faux painting. More particularly, the invention pertains to such a tray capable of receiving and keeping separate from each other different faux painting materials and applicators. The tray is also formed in such a way that a plurality of trays may be stored in nested, stacked relationship.

2. Description of the Prior Art

Faux painting is a decorative type of painting often used as a substitute for traditional wallpaper or plain finishes. In faux painting, the artisan utilizes a variety of paint applicators, such as brushes and sponges, in order to achieve the desired finish. Common types of faux painting are marbleizing, stripping and sponging. For example, in marbleizing the artisan may apply paint to a wooden column in such a manner so as to give the appearance that the column is made of real marble.

Faux painting can often be a very tedious undertaking because of the level of detail involved in creating the various finishes. The artisan generally must use several different colors of paint and applicators in order to achieve a desired finish. The artisan needs to have close and convenient access to these different paints and applicators in order to be as efficient as possible in the faux painting process. There is a real need in the art for a painting tray capable of giving the artisan this close and convenient access to different paints and applicators, while at the same time capable of being carried using only one hand so that the artisan's other hand is free to apply the faux painting materials. It is also desirable, in a practical sense, for the tray to be nestably stackable with other such trays so as to minimize the storage space required when the trays are not in use.

SUMMARY OF THE INVENTION

The current invention solves this problem by providing a nestable multiple compartment tray for faux paints and applicators. The invention comprises a rigid one-piece monolithic housing which comprises a bottom wall structure and a sidewall, a series of first divider walls and at least one second divider wall. The housing bottom wall structure presents an outer perimeter defined by a plurality of spaced bottom wall segments. The sidewall has a plurality of individual, spaced segments connected to respective bottom wall segments at the perimeter of the bottom wall structure. These sidewall segments present front, rear, and opposed side sections. The first divider walls extend between the front and rear sections of the sidewall, and the second divider wall intersects the first divider walls and extends between the opposing side sections of the sidewall.

The first and second divider walls cooperate with the sidewall segments and bottom wall segments to present individual fore applicator receiving compartments and aft paint receiving compartments. Preferably, the second divider wall is located closer to the front section of the sidewall than the rear section of the sidewall. This feature leaves the fore applicator receiving compartments narrower than the aft paint receiving compartments.

Each divider wall is constructed with at least partially spaced wall portions which present corresponding cavities therebetween. These wall portions and cavities are configured and oriented to permit interleaving of the divider walls of a plurality of trays in nested, stacked relationship.

In one embodiment, the second divider wall contains grooves for receiving either the paint applicators themselves or the handles of the paint applicators.

Figure 1:
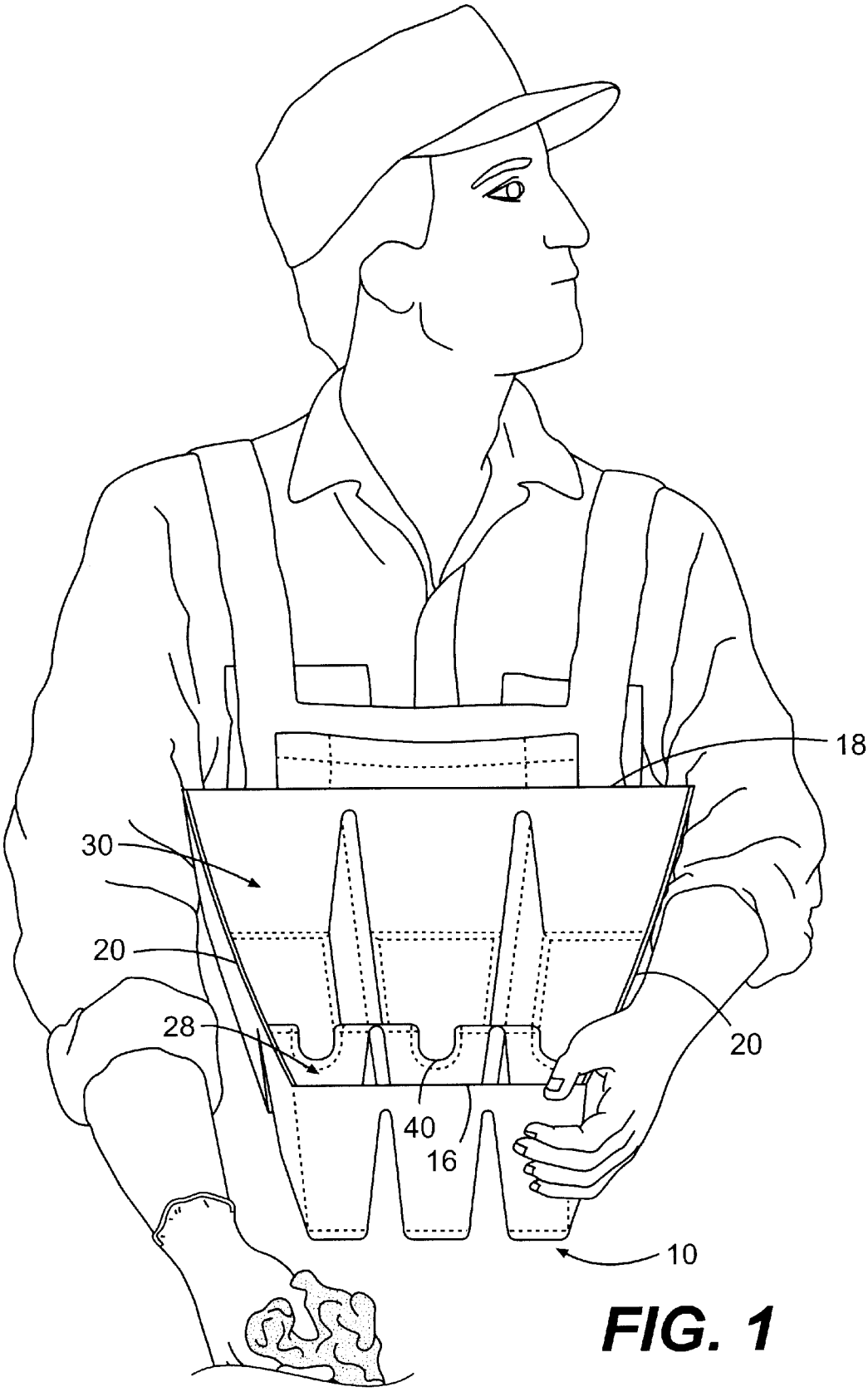
FIG. 1 is a view demonstrating a faux painting artisan using the nestable multiple compartment tray in a preferred manner.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

Figure 2:
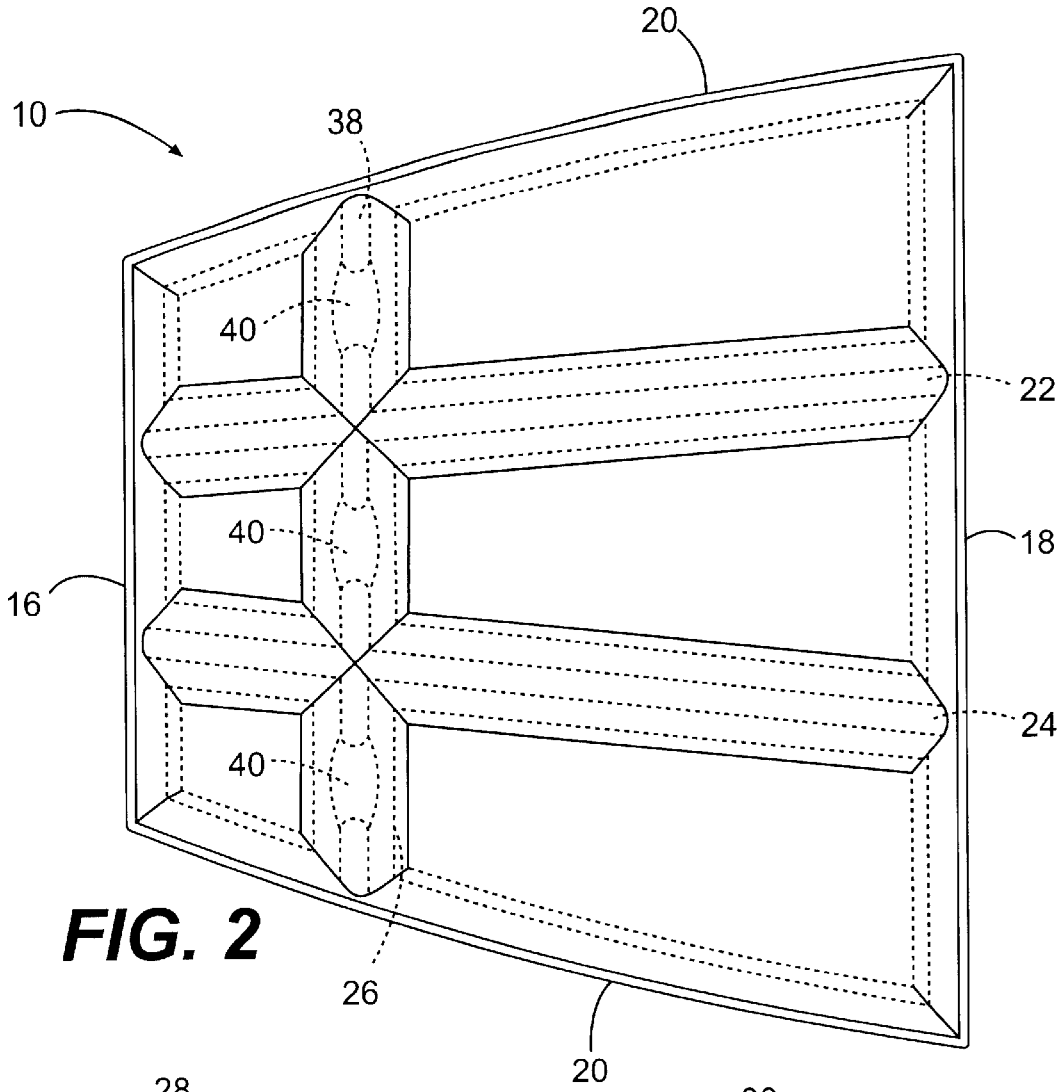
FIG. 2 is a top view of the tray.
Figure 4:
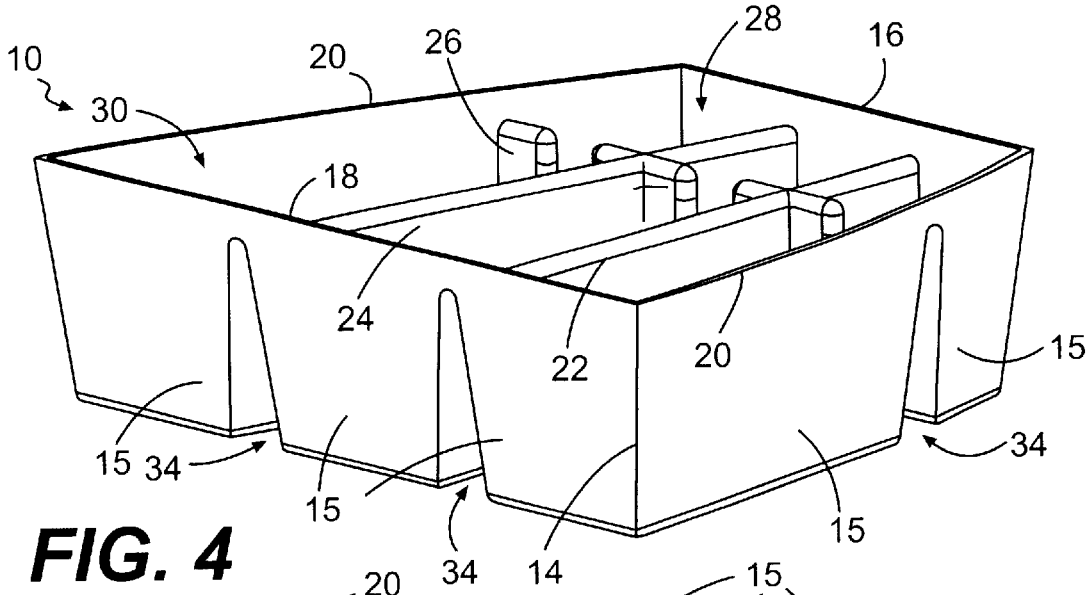
FIG. 4 is an elevational view of the tray demonstrating the paint and paint applicator-receiving compartments.
Figure 5:
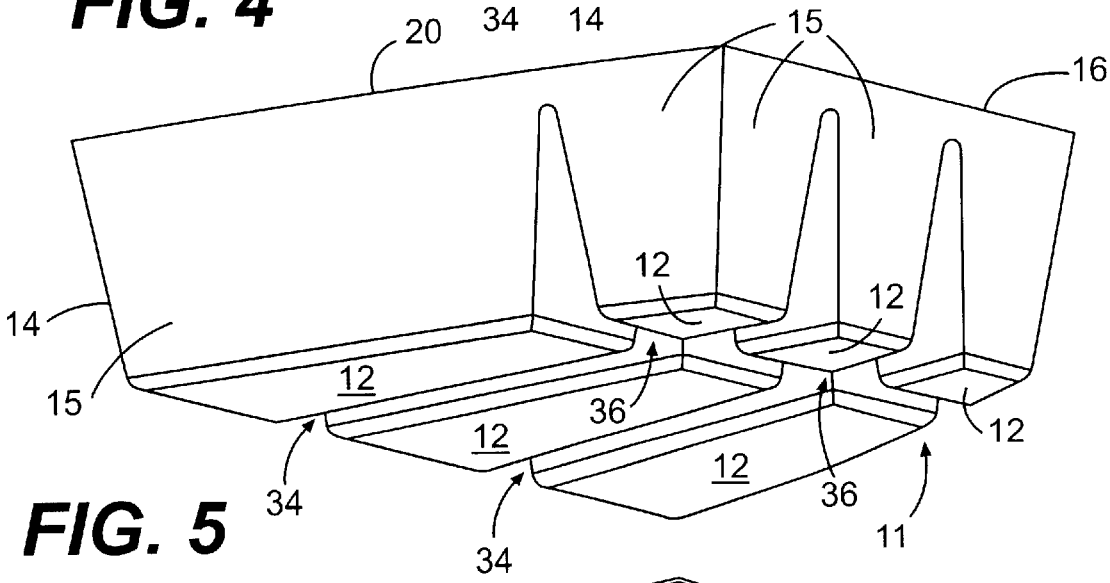
FIG. 5 is an elevational view of the tray demonstrating the bottom wall segments and cavities formed by the partially spaced divider wall segments.

Turning now to the drawings, and more specifically FIG. 1, the nestable multiple compartment tray 10 is of one-piece monolithic construction. The tray may be constructed from any rigid material suitable for holding faux painting materials, however, preferably, the tray is constructed of a rigid, molded plastic material. As shown in FIG. 5, the tray 10 is comprised of a housing comprising a bottom wall structure 11 presenting an outer perimeter and defined by a plurality of spaced bottom wall segments 12. The housing also comprises a sidewall 14 having a plurality of individual, spaced segments 15 connected to respective bottom wall segments 12 at the perimeter of the bottom wall structure. The sidewall segments 15 present front 16, rear 18 and opposing side 20 sections. As shown in FIG. 2, the tray further comprises a series of first divider walls 22 and 24 and at least one second divider wall 26. The first divider walls 22, 24 cooperate with the sidewall segments 16, 18, 20 to present individual fore compartments 28 and aft compartments 30. Preferably the first divider walls 22, 24 extend the full length between the front 16 and rear 18 sections of the sidewall 14, and preferably the second divider wall 26 extends the full length between the opposing side sections 20. In the preferred embodiment shown in FIG. 4, the divider walls 22, 24, 26 also have a height approaching the height of the sidewall 14.

FIG. 1 demonstrates one manner of use of the tray 10 by a faux painting artisan. The artisan holds the tray 10 so that the rear section 18 of the sidewall is against the artisan's chest. The artisan, using one arm wrapped around one of the opposed side sections 20 of the tray 10, supports the front section of the sidewall 16 using his hand. Holding the tray in this fashion leaves the artisan's other arm and hand free to hold an applicator and apply the faux painting materials.

Figure 6:
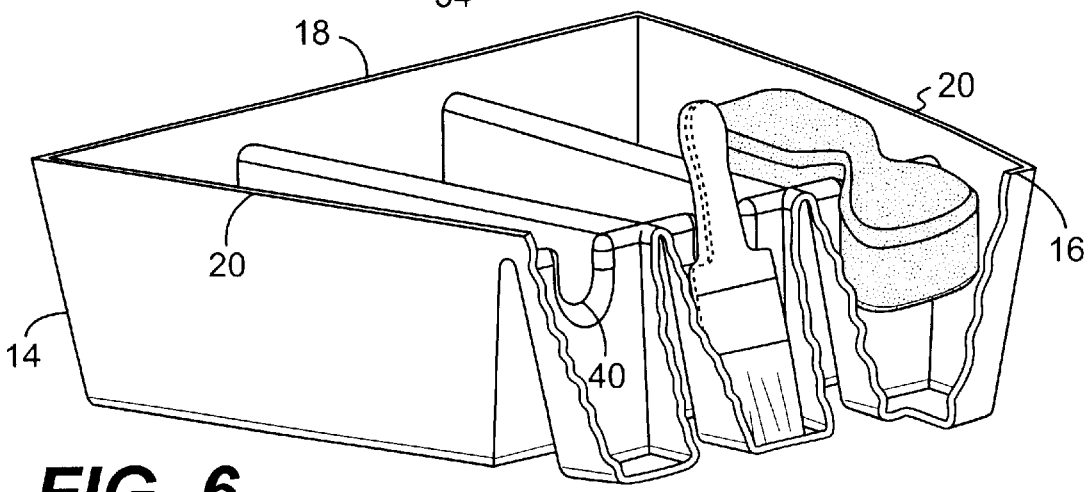
FIG. 6 is an elevational view of the tray with wall segments of the fore applicator receiving compartments cut away demonstrating the applicator receiving grooves of the bight section of the cross-divider walls.

In the preferred embodiment of the invention, the second divider wall 26 is located closer to the front section of the sidewall 16 than the rear section of the sidewall 18. This leaves the fore compartments 28 narrower than the aft compartments 30. The fore compartments 28 are suitable for receiving paint applicators as shown in FIG. 6, and the aft compartments 30 are suitable for receiving the paint materials used in the faux painting process.

Figure 3:
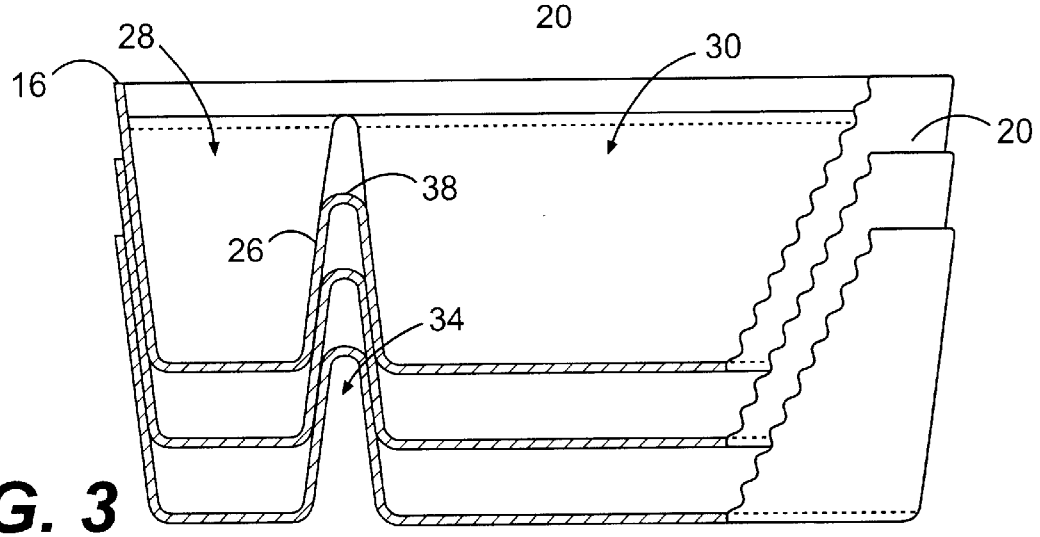
FIG. 3 is a side view of a plurality of trays in nested, stacked relationship with portions of the tray sidewall cut away.

Another feature of the preferred embodiment of this invention is that the tray is designed in such a way to allow a plurality of trays to be nested together, thus facilitating compact storage of the trays. As FIG. 3 demonstrates using the second divider wall 26 as an example, each of the divider walls 22, 24, 26 has at least partially spaced wall portions 32 presenting corresponding cavities 34 therebetween. These cavities 34 are configured and oriented to permit interleaving of the divider walls 22, 24, 26 of a plurality of trays in nested, stacked relationship. The intersections of the first divider walls 22, 24 with the second divider wall 26 define cavity sections 36 at least partly bounded by the partially spaced wall portions 32 of the intersecting divider walls.

The divider walls 22, 24, 26 present bight sections 38 that connect the spaced wall portions 32. In the preferred embodiment of this invention, the spaced wall portions 32 and the bight section 38 form an inverted U-shape thus defining an inverted U-shaped cavity 34. The bight sections 38 of the cross-divider walls 26 may also contain grooves 40 for receiving paint applicators. As shown in FIG. 6, these grooves 40 may be arcuate-shaped depressions formed in the bight sections 38 of the second divider wall 26.

It is also preferable that the divider walls 22, 24, 26 present a height approaching the height of the sidewall 14. It is most preferable that the sidewall 14 extend above the height of the divider walls 22, 24, 26. This added sidewall height provides additional structural support thereby increasing the rigidity of the tray 10.

It is also preferred that the opposed side sections of the sidewall 20 converge between the front 16 and rear 18 sections of the sidewall so that the space between the opposed side sections 20 proximal the front section of the sidewall 16 is less than the space between the opposed side sections 20 proximal the rear section of the sidewall 18. In preferred embodiments, this convergence of the side sections of the sidewall 20 is such that the sidewall takes on a generally trapezoidal shape.

In the most preferred embodiment of the invention, the length of front section of the sidewall 16 is about 8 inches. The length of the rear section of the sidewall 18 is about 16 inches and the lengths of the opposing side sections of the sidewall 20 are about 13 inches. In this embodiment, the sidewall 14 presents a height of about 5.5 inches.

I claim:

1. A nestable multiple compartment tray for faux paints and paint applicators, comprising:

a rigid one-piece monolithic housing including:

a bottom wall structure presenting an outer perimeter and defined by a plurality of spaced bottom wall segments, and a sidewall having a plurality of individual, spaced segments connected to respective bottom wall segments at the perimeter of the bottom wall structure, said sidewall segments presenting, front, rear and opposed side sections, said opposed side sections of the sidewall converging between the front and rear sections of the sidewall so that a first distance between the opposed side sections proximal the front section of the sidewall is less than a second distance between the opposed side sections proximal the rear section of the sidewall;

a plurality of first divider walls extending from and being connected to the front and rear sections of the sidewall, and at least one second divider wall intersecting said plurality of first divider walls and extending from and being connected to the opposed side sections of the sidewall, said second divider wall being located closer to the front section of the sidewall than the rear section of the sidewall, wherein the first and second divider walls cooperate with the sidewall segments and bottom wall segments to present individual fore applicator receiving compartments and aft paint receiving compartments, said fore applicator receiving compartments being narrower than said aft paint receiving compartments, and wherein each of said first and second divider walls has at least partially spaced wall portions presenting corresponding cavities therebetween, said wall portions and the cavities presented thereby being configured and oriented to permit interleaving of the divider walls of a plurality of trays in a nested, stacked relationship.

2. The nestable multiple compartment tray of claim 1, wherein said second divider wall comprises a bight section having grooves formed therein adapted to receive paint applicators.

3. The nestable multiple compartment tray of claim 2, wherein said grooves comprise arcuate-shaped recesses.

4. The nestable multiple compartment tray of claim 1, wherein said at least partially spaced divider wall portions define inverted U-shaped cavities.

5. The nestable multiple compartment tray of claim 1, wherein said first divider walls extends a first full length between the front and rear sections of the sidewall.

6. The nestable multiple compartment tray of claim 5, wherein said second divider wall extends a second full length between the opposing side sections of the sidewall.

7. The nestable multiple compartment tray of claim 1, wherein intersections of said first and second divider walls define cavity sections at least partly bounded by the partially spaced wall portions of the first and second divider walls.

8. The nestable multiple compartment tray of claim 1, wherein said first and second divider walls have a first height that is not greater than a second height of said sidewall.

9. A compartmentalized tray comprising:

a housing presenting a bottom wall structure and an upstanding sidewall including:

opposed front and rear wall sections, and opposed side sections extending between the front and rear wall sections, said side sections converge between the front and rear wall sections so that a first distance between the side sections proximal the front wall section is less than a second distance between the side sections proximal the rear wall section;

a plurality of spaced fore and aft extending first divider walls having a generally uniform ridge extending from and being connected to said front and rear wall sections, and at least one second divider wall extending between from and being connected to said side sections and intersecting said first divider walls, said at least one second divider wall is positioned closer to said front wall section than said rear wall section, said at least one second divider wall including at least partially spaced wall portions and a bight section connecting the at least partially spaced wall portions, the wall portions presenting cavities therebetween, and the bight section including at least one groove formed therein, wherein said bottom wall structure, sidewall, and said first and second divider walls define a plurality of fore and aft compartments within the housing, and said at least one groove communicating with one of said compartments.

10. The tray of claim 9, wherein said first and second divider walls comprise a first height that is not greater than a second height of said sidewall.

11. The tray of claim 9, wherein said second divider wall comprise a respective groove cooperating with each of said fore compartments.

12. The tray of claim 9, wherein said bottom wall structure comprises a plurality of spaced bottom wall segments.

13. The tray of claim 9, wherein each of said first and second divider walls comprises at least partially spaced wall portions presenting cavities therebetween.

14. The tray of claim 13, wherein said at least partially spaced wall portions and said cavities are configured and oriented to permit interleaving of the first and second divider walls of a plurality of trays in a nested, stacked relationship.

15. The tray of claim 13, wherein said at least partially spaced wall portions define inverted U-shaped cavities.

16. A compartmentalized tray comprising:

a housing including:

a bottom wall structure, said bottom wall structure including a plurality of spaced bottom wall segments lying in a common plane, and an upstanding sidewall including:

opposed front and rear wall sections, and opposed side sections extending between the front and rear wall sections, said side sections converge between the front and rear wall sections so that a first distance between the side sections proximal the front wall section is less than a second distance between the side sections proximal the rear wall section;

a plurality of spaced first divider walls extending from and being connected to said front and rear wall sections, and at least one second divider wall extending from and being connected to said side sections and intersecting said first divider walls, said at least one second divider wall being positioned closer to said front wall section than said rear wall section, and said at least one second divider wall including at least partially spaced wall portions presenting cavities therebetween, wherein said bottom wall structure, sidewall, and said first and second divider walls define a plurality of compartments within the housing.

17. The tray of claim 16, wherein said at least one second divider wall comprises at least one groove communicating with one of said plurality of compartments.

18. The tray of claim 17, wherein said at least one second divider wall comprises a plurality of grooves, and each groove of the plurality of grooves cooperates with a respective compartment of the plurality of compartments.

19. The tray of claim 16, wherein said first and second divider walls comprise a first height that is not greater than a second height of said sidewall.

20. The tray of claim 16, wherein each of said first and second divider walls comprises at least partially spaced wall portions presenting cavities therebetween.

21. The tray of claim 20, wherein said partially spaced wall portions and said cavities are configured and oriented to permit interleaving of the first and second divider walls of a plurality of trays in a nested, stacked relationship.

22. The tray of claim 20, wherein said cavities comprise inverted U-shaped cavities.

* * * * *